US009242160B2

(12) United States Patent
Tyndall

(10) Patent No.: US 9,242,160 B2
(45) Date of Patent: Jan. 26, 2016

(54) PITCHING MAT DEVICE

(71) Applicant: Lauren Tyndall, Chicago, IL (US)

(72) Inventor: Lauren Tyndall, Chicago, IL (US)

( * ) Notice: Subject to any disclaimer, the term of this patent is extended or adjusted under 35 U.S.C. 154(b) by 0 days.

(21) Appl. No.: 14/256,645

(22) Filed: Apr. 18, 2014

(65) Prior Publication Data

US 2015/0297966 A1 Oct. 22, 2015

(51) Int. Cl.

| | |
|---|---|
| ***A63B 71/12*** | (2006.01) |
| ***A63B 69/00*** | (2006.01) |
| ***A63B 71/02*** | (2006.01) |

(52) U.S. Cl.

CPC ..... *A63B 69/0013* (2013.01); *A63B 71/02* (2013.01); *A63B 2069/0006* (2013.01); *A63B 2243/0008* (2013.01)

(58) Field of Classification Search

CPC ..... D06N 7/0063; A63B 69/002; A63B 2069/0006; A63B 69/3661; A63B 21/00105; A63B 21/1473; A63B 2069/3664; A63B 71/00; A63B 69/00; A63B 2069/0004; A63B 2069/0008; A63B 2069/0011; A63B 69/3652; A63B 69/3676; A63F 7/0608

USPC ..... 273/317.6, 108.3, 108.33, 109; 473/497, 454, 278, 499, 451, 468, 159, 473/162

See application file for complete search history.

(56) References Cited

U.S. PATENT DOCUMENTS

| | | | | |
|---|---|---|---|---|
| 3,181,863 | A | 5/1965 | Nellermoe | |
| 3,599,982 | A * | 8/1971 | Elesh | 473/278 |
| 4,561,653 | A * | 12/1985 | Wright | 473/497 |
| 4,666,155 | A | 5/1987 | Stille | |
| 5,000,449 | A | 3/1991 | Weeks | |
| 5,154,961 | A * | 10/1992 | Reuben | 428/82 |
| 6,386,996 | B1 | 5/2002 | Foster | |
| 7,717,813 | B2 | 5/2010 | Sinovich | |
| 7,935,007 | B1 * | 5/2011 | Gawryla | 473/452 |
| 8,167,746 | B2 | 5/2012 | Massaro | |
| 8,337,340 | B2 * | 12/2012 | Clark | 473/497 |
| 2006/0068947 | A1 | 3/2006 | Kempf | |
| 2009/0124436 | A1 | 5/2009 | Nimmons | |
| 2009/0270206 | A1 * | 10/2009 | Massaro | 473/497 |
| 2011/0021296 | A1 * | 1/2011 | Johnston | 473/452 |

OTHER PUBLICATIONS

Just Baseball, Jan. 12, 2012, Figure on p. 1.*
Professional Removable Pitching Rubber, Mar. 29, 2013, p. 2 Specification.*
8' Pro-Gold Porta-Mat 04842, Discount Sporting Supply.
Powerline Pitching Mat, Club K and Co. Inc.
Anchor-Runner Clear Vinyl Carpet Runner Mat 48" Wide—5/16" Thick, The WEBstaurant store.

* cited by examiner

*Primary Examiner* — Alvin Hunter
*Assistant Examiner* — Rayshun Peng
(74) *Attorney, Agent, or Firm* — Cherskov Flaynik & Gurda, LLC

(57) ABSTRACT

The present invention provides a portable pitching mat having a first side with a first end and a second end, wherein the first side is substantially flat and has a weight attached proximal to the first end; a second side, wherein the second side engages an artificial turf substrate with a plurality of anchors; and a pitching rubber on the first side proximal to the first end. Also provided is a portable mat having a first side with a first end and a second end, wherein the first side is substantially flat; a second side, wherein the second side has a plurality of recessed regions; and a plurality of substrates, wherein each of the plurality of substrates comprises a first face that reversibly engages one of the plurality of recessed regions on the second side; and a second face that engages an artificial turf surface with a plurality of anchors.

2 Claims, 5 Drawing Sheets

FIG. 3 (detail)

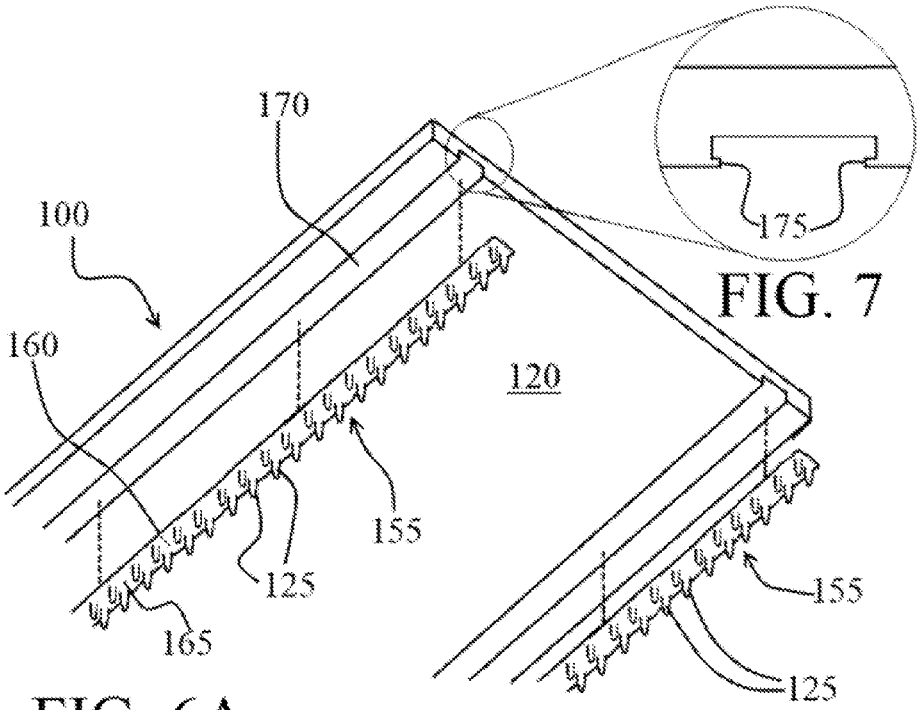
FIG. 7
FIG. 6A
FIG. 6B
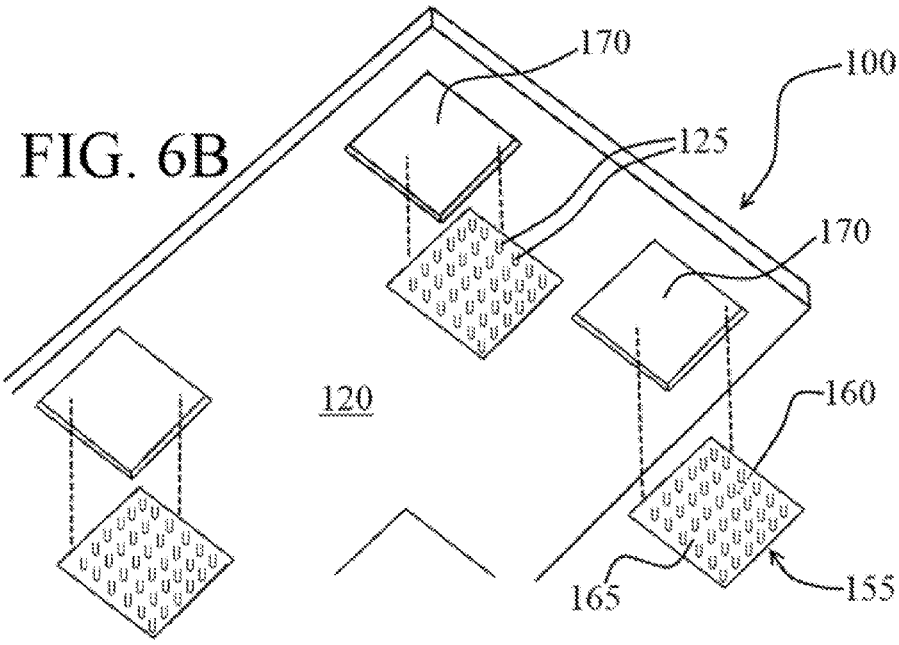

PITCHING MAT DEVICE

BACKGROUND OF THE INVENTION

1. Field of the Invention

One embodiment of the present invention is directed to a softball pitching mat for use with artificial turf surfaces; although the embodiment is suitable for use on other play surfaces as well, including grass and dirt. Another embodiment of the present invention is directed to a softball pitching mat that can be adapted for use on all surfaces.

2. Background of the Invention

Softball is typically thought of as a summer sport. However, much of the training for the season takes place during the winter and spring. During the winter, snow fall and cold temperatures limit a pitcher's ability to practice outdoors. During the spring, rainfall and soggy ground, as well as unpredictable cold snaps, can similarly frustrate a pitcher's chances of practicing outdoors. Thus, practice during these times frequently takes place indoors in training facilities.

Some indoor facilities have tile or wood floors. On these surfaces, pitchers often use or are required to use mats. Pitching mats provide a pitching surface that contains a pitching rubber. A pitcher begins a pitch standing on the pitching surface and pushes off the pitching rubber to create momentum going into the pitch. A pitching rubber placed directly on the tile or wood surface does not stay in place because there is not enough frictional engagement between the floor surface and the rubber. Therefore, a pitching mat with an integral pitching rubber is used so that there is greater contact between the surface of the mat and the surface of the floor. These pitching mats are typically expensive, heavy, and unwieldy.

Other indoor facilities have artificial turf playing surfaces. Artificial turf can become damaged when a pitcher repeatedly drives her foot into the same spot on the ground. This repetitive action can cause the grass blades to tear out and the artificial turf infill particles to shift. Eventually, this creates a divot in the turf that is costly to repair. Further, if the divots are not repaired, they can become an injury hazard for other users. Unfortunately, though, the best way to practice pitching is to repeatedly pitch. Moving to different areas between pitches is time consuming and cumbersome.

Some have tried to use pitching mats to protect the artificial turf. However, such mats are designed for use with gym floors, and they tend to slip or crinkle when used on a turf surface. Repositioning the pitching mat after each pitch or after every couple of pitches is an annoyance that many pitchers would like to avoid.

Therefore, a need exists in the art for a device that enables a pitcher to practice on artificial turf without damaging the turf or creating divots and that will not slip or crinkle on the surface of the artificial turf. Another need exists in the art for a pitching mat that can be used on both gym floors and on artificial turf.

SUMMARY OF THE INVENTION

An object of the present invention is to overcome the disadvantages of the prior art pitching mats.

Another object of the present invention is to provide a pitching mat that protects an artificial turf substrate from damage, resulting from the repetitive action of pitching practice. A feature of the present invention is that the rubber pitching surface protects the artificial turf from damage during use. An advantage of the present invention is that a pitcher can get additional practice indoors during inclement weather without damaging an artificial turf surface.

Yet another object of the present invention is to provide a pitching mat that does not slip or crinkle on an artificial turf surface. A feature of the present invention is the anchors on the underside of the pitching mat that engage the artificial turf surface and that prevent slipping. An advantage of the present invention is that the pitcher does not have to continually readjust and reposition the pitching mat.

Still another object of the present invention is to provide a pitching mat that is easily transportable. A feature of the present invention is that the mat is made from a flexible material so that it can be rolled up between uses. Another feature of one embodiment of the present invention is that the pitching rubber is removable. An advantage of the present invention is that the pitching mat can easily be deployed and stored by a pitcher between uses.

A further object of the present invention is to provide a pitching mat that can be used on both flat surfaces, such as tile or wood floors, and on artificial turf. A feature of the present invention is that the anchors providing the means of attaching the mat to artificial turf are removable, in one embodiment. An advantage of the present invention is that a pitcher only needs one pitching mat for a variety of different surfaces. A further advantage of the present invention is that it is cheaper and lighter than prior art pitching mats.

The present invention provides a portable pitching mat, said mat comprising a first side with a first end and a second end, wherein the first side is substantially flat and has a weight attached proximal to the first end; a second side, wherein the second side engages an artificial turf substrate with a plurality of anchors; and a pitching rubber on the first side proximal to the first end.

The present invention also provides a portable mat, said mat comprising a first side with a first end and a second end, wherein the first side is substantially flat; a second side, wherein the second side has a plurality of recessed regions; and a plurality of substrates, wherein each of the plurality of substrates comprises a first face that reversibly engages one of the plurality of recessed regions on the second side; and a second face that engages an artificial turf surface with a plurality of anchors

BRIEF DESCRIPTION OF THE DRAWINGS

The invention together with the above and other objects and advantages will be best understood from the following detailed description of the preferred embodiment of the invention shown in the accompanying drawings, wherein:

FIG. 3 is a detail view of the anchor engaging the artificial turf surface;

FIG. 6A-B depict a second embodiment of the invented pitching mat with removable anchors in accordance with the features of the present invention; and FIG. 7 depicts a detail view of the channel of FIG. 6A.

DETAILED DESCRIPTION OF THE INVENTION

The foregoing summary, as well as the following detailed description of certain embodiments of the present invention, will be better understood when read in conjunction with the appended drawings.

As used herein, an element recited in the singular and preceded with the word "a" or "an" should be understood as not excluding plural said elements or steps, unless such exclusion is explicitly stated. Furthermore, the references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The present invention is directed to a pitching mat. More specifically, an embodiment of the present invention is directed to a pitching mat that is optimized for use on artificial turf surfaces. Another embodiment of the pitching mat is directed to a pitching mat that can be used on all surfaces.

The Pitching Mat

Figure 1:
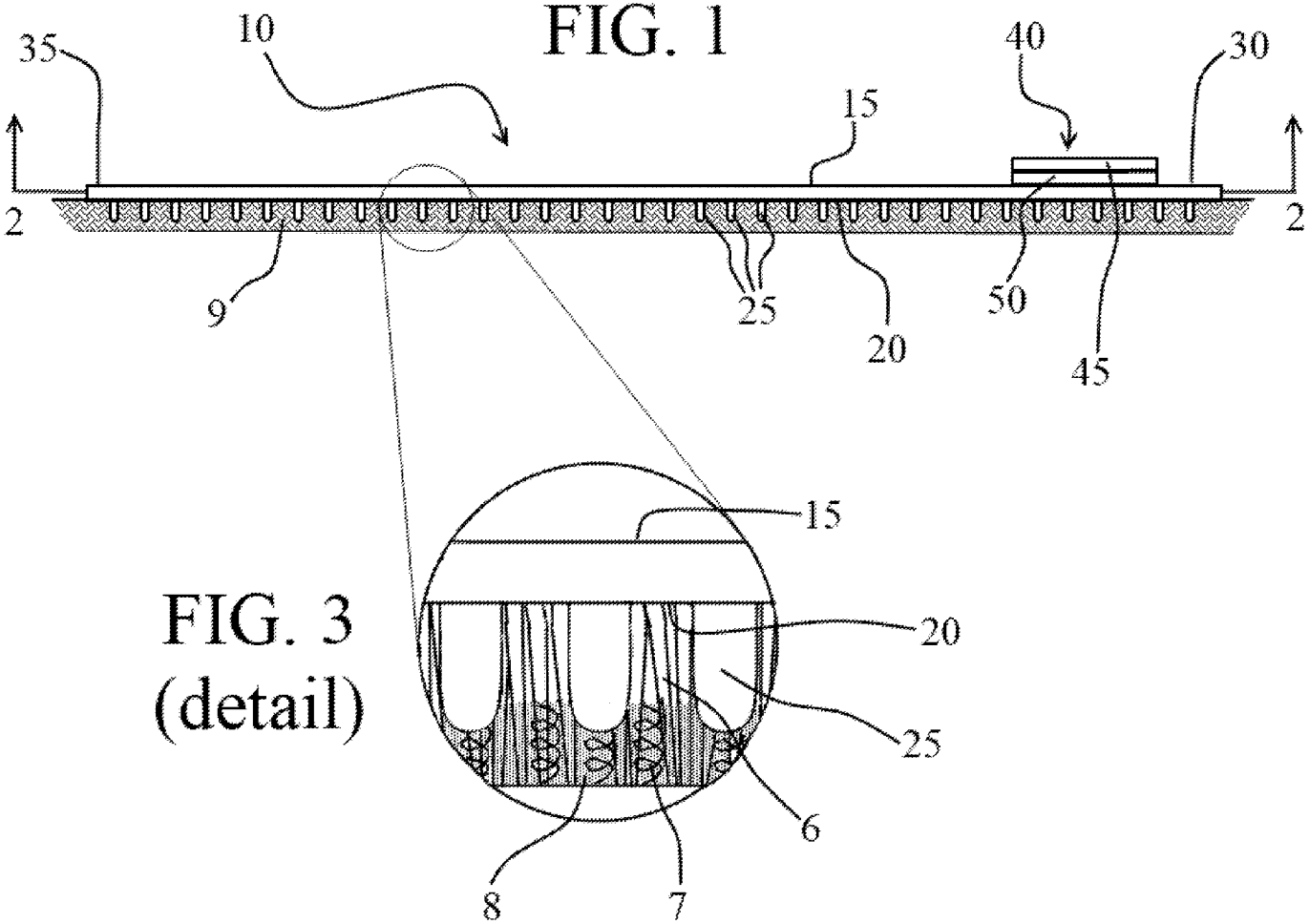
FIG. 1 is a side view of a first embodiment of the invented pitching mat in accordance with the features of the present invention.

As can be seen in FIG. 1, the pitching mat 10 is comprised of a first side 15 and a second side 20. The first side 15 is substantially flat, while the second side 20 features a plurality of anchors 25. The anchors 25 are designed to engage an artificial turf surface 9.

The pitching mat 10 can be made from a variety of suitable materials. Preferably, the pitching mat 10 is made from a flexible material so that the pitching mat 10 can be rolled up or folded for storage. Typically, the pitching mat will have a thickness between 1/32 inch and 1.5 inches. Suitable materials for the pitching mat include: heavy gauge vinyl, silicone rubber, PET, nylon, synthetic rubber, PVC foam/sponge, nitrile, polypropylene, and combinations thereof. This list is not exhaustive; other materials not featured in this list could also serve as suitable pitching mats.

The pitching mat 10 has a first end 30 and a second end 35. A pitching rubber 40 is mounted to the pitching mat 10 proximal to the first end 30. As depicted in FIG. 1, the pitching rubber 40 is comprised of multiple layers, with two layers shown in FIG. 1: a first layer 45 and a second layer 50. In one embodiment, the first layer 45 is a strip of rubber and the second layer 50 is a substrate functioning as a weight and having proportions substantially the same as the first layer 45. Alternatively, the second layer 50 could be a receptacle to hold a removable weight. A regulation pitching rubber has a length of twenty-four inches and a width of six inches; however, different measurements can be used. In an embodiment of the pitching mat 10 with a first rubber layer 45 and a second weighted layer 50, the total thickness of the mat and layers is approximately 1.75 cm, but this thickness will vary depending on the materials used.

The first layer 45 is designed to mimic the feel of a pitching rubber. For that purpose, in one embodiment, the first layer uses styrene-butadiene rubber, or silicone rubber, or EPDM rubber, or combinations thereof. These rubbers are all durable and could withstand pressure from a pitcher repeatedly pushing off of the first layer 45, especially a pitcher who is wearing cleats. Further, these rubbers mimic the feel of an in-game pitching rubber.

The pitching rubber 40 needs to be stable because the pitcher will be pushing off of it to gain momentum going into the pitch. The inventor has found that a weight of at least three pounds is suitable to provide sufficient support. If the first layer weighs at least three pounds, then the second layer 50 is optional; however, the number of layers can vary and can be more than two layers if so desired by the user. In other embodiments, a weight is added to the rubber stack, in one embodiment, the weight is integrally molded with one of the layers, such as a weight encased in a rubber coating. In a preferred embodiment, the second layer 50 comprises an integral weight. A variety of materials can serve as suitable weights. Metals typically have the highest density among common uses engineering materials and can easily provide the requisite weight within the size constraints of the pitching rubber.

The pitching rubber 40 is permanently attached to the pitching mat 10 in one embodiment. In another embodiment, the pitching rubber 40 is removable. If it is a permanent feature, then the first layer 45 can be integrally molded with the pitching mat 10, encasing the second layer 50. In embodiments where the pitching rubber 40 is not integrally molded, a pin could join the first layer 45, the second layer 50, and the pitching mat 10. Further, a variety of bonding agents, adhesives, or glues could be used to secure the layers together. Further still, the pitching rubber 40 could be sewn into the pitching mat 40. In embodiments where the pitching rubber 40 is removable, the pitching rubber 40 is securely yet removably attached to the pitching mat 10 in a variety of attachment types, such as a hook and loop fastener, a removable pin system, a pin on the pitching rubber 40 that slidably engages a locking groove in the mat 10, a nut and bolt assembly, or a plurality of heavy duty button snaps. Providing a removable pitching rubber 40 helps to store and carry the pitching mat between uses. Also, should the pitching rubber 40 become damaged, a removable pitching rubber 40 allows for replacement of the individual component versus replacement of the entire device.

Figure 2:
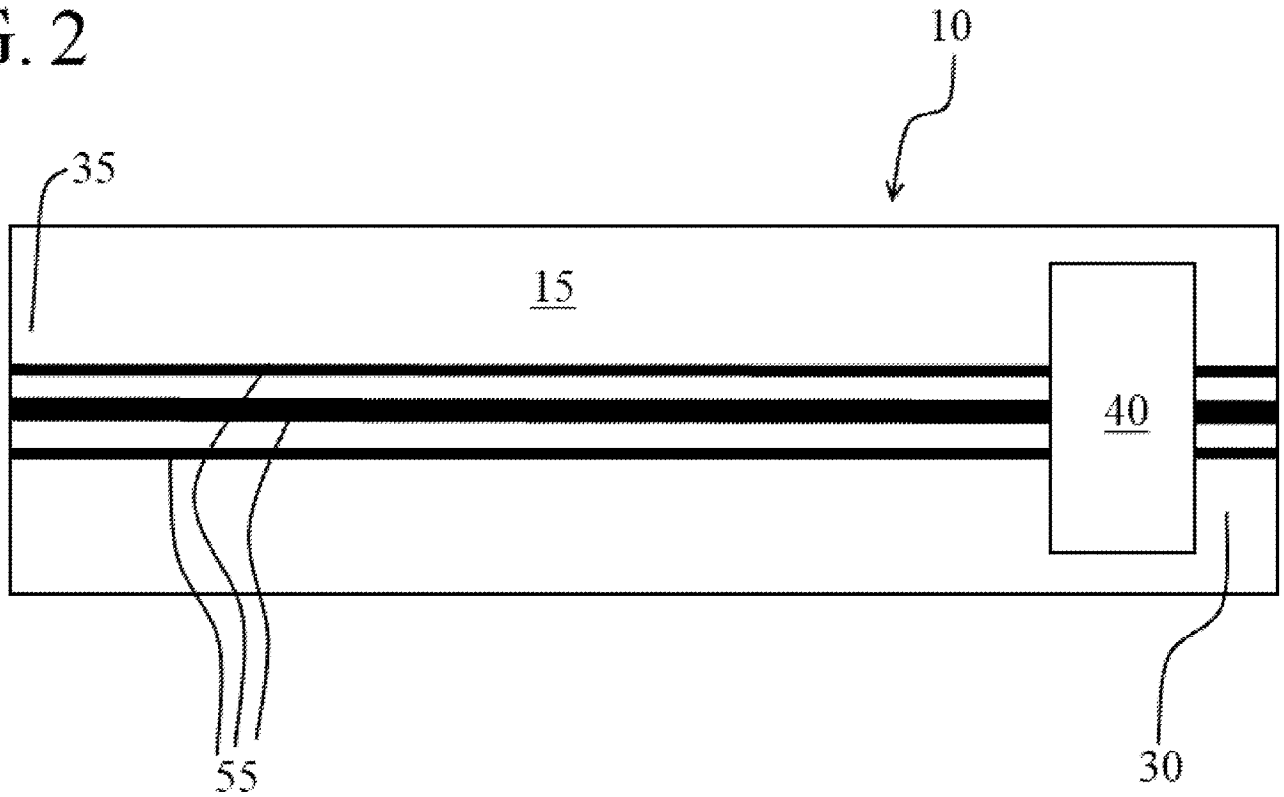
FIG. 2 is view taken along line 2-2 of FIG. 1.

As can be seen in FIG. 2, the first top side of the pitching mat 10 features a series of lines 55 down the middle of the mat. These lines 55 are referred to as the "power line" or the "line of force." In one embodiment, the lines comprise a single stripe in the middle of the mat 10. On a softball diamond, the power line is an imaginary line that runs from the tip of home plate through the center of the pitching rubber. A pitcher whose plant foot lands on the power line during a pitch typically experiences increased speed and accuracy. Therefore, including the lines 55 on the first side 15 of the pitching mat 10 provides the pitcher with a visual reference of whether she is hitting the power line. Using multiple lines provides a reference for the pitcher to tell how far away from the power line the pitcher is when completing the pitch. The lines 55 are omitted from some embodiments of the invention. More or fewer lines 55 could be included, or no lines 55 could be included. Further, the thickness of the lines could vary. In some embodiments, the lines 55 are also removable. The removable lines could feature an adhesive coating, they could be made from a static cling material, or they could be attached with a suitable fastener, such as a hook and loop fastener, button snaps, or a threaded fastener.

Interaction with Artificial Turf

Artificial turf has been used as a substitute for grass in a variety of applications since at least the 1960s. The first generation of artificial turf contained only synthetic fibers, which imitated blades of grass. As can be seen in FIG. 3, conventional artificial turf presently installed generally contains straight fibers 6, curly fibers 7, and infill material 8. The curly fibers 7 help to keep the straight fibers 6 upright. The infill material 8 is most often rubber pellets, but sand is also used, especially in outdoor applications. The infill material 8 also helps keep the fibers upright, and the infill material cushions against falls.

The anchors 25 are designed to engage the straight fibers 6, the curly fibers 7 and infill material 8 of conventional artificial turf 9. The straight fibers 6 are densely arranged to simulate actual grass. The anchors 25 penetrate the thicket of fibers 6 and entangle themselves within the straight fibers 6. The anchors 25 also penetrate into the infill material 8.

When the user steps on the pitching mat, the weight of the user will force the anchors 25 down between the fibers 6, 7 and into the infill material 8. At the same time, the fibers 6, 7 and infill material 8 are also compacted around the anchors 25. When making a pitch, a pitcher's first move is typically to shift her weight onto the pitching rubber 40. Next, the pitcher will take a large step forward with her plant foot. Some pitchers will then drag the trailing foot on their follow through. The plant step or dragging follow through are the actions which most often causes a prior art mat to slide or crinkle because of the pitcher's momentum towards the second end 35. However, because the fibers 6, 7 and infill material 8 are compressed under the weight of the user and around the anchor 25, the pitching mat 10 is unable to slide forward because the fibers 6, 7 and infill material 8 resist the movement of the anchors 25. Thus, because the individual anchors 25 cannot move, the pitching mat 25 is prevented from sliding or crinkling. If the pitching mat 10 is used on first generation artificial turf, then the anchors 25 only engage the thicket of synthetic fibers.

In one embodiment, the pitching mat 10 is between seven and ten feet long and between two and five feet wide. In a preferred embodiment, the pitching mat 10 is nine feet long and twenty-seven inches wide. Thus, the area of the second side 20 is 20.25 $ft^2$. The anchors 25 are dispersed throughout this area. The anchors 25 can be dispersed randomly or in regular patterns; however, for the best results, the anchors 25 should thoroughly cover the areas of the pitching mat 10 that experience the greatest forces, including the first end 30 near the pitching rubber 40, the midpoint of the pitching mat 10 where the pitcher plants her foot, and the area in between where the pitcher drags her back foot.

Figure 4A:
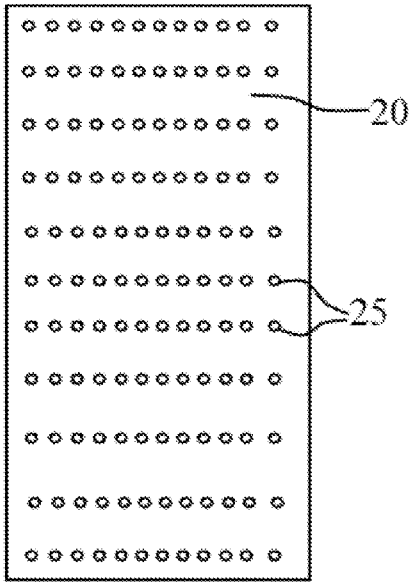
FIGS. 4A-C depict a plurality of anchor arrangements.
Figure 4B:
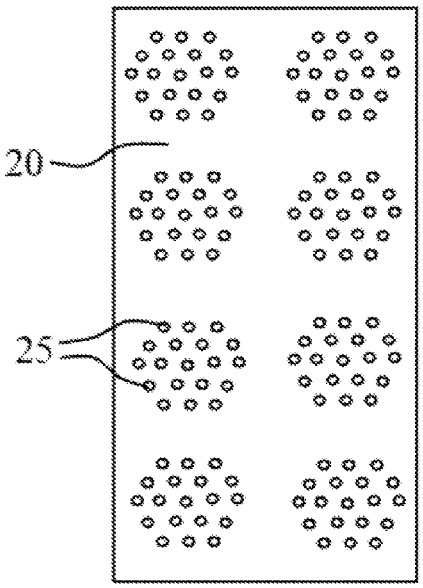
Figure 4C:
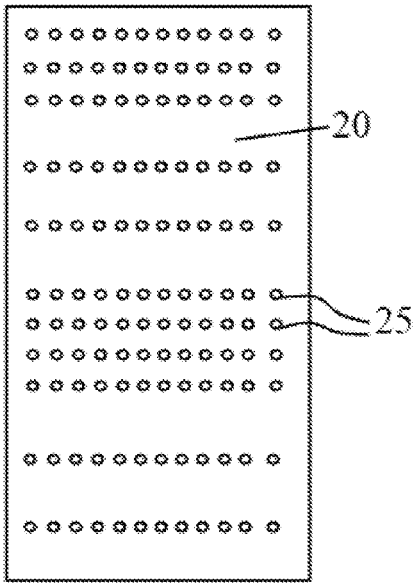

FIGS. 4A-C show several designs for the placement of the anchors 25 on the second side 20. FIG. 4A depicts a linear arrangement in which the anchors 25 are placed at regular intervals along rows and columns. The inventor has found that between 40 and 400 anchors per square foot is a suitable density of anchors 25 to prevent slipping of the pitching mat 10. Preferably, the second side contains between 140 and 300 anchors per square foot and most preferably between approximately 160 and approximately 190 anchors per square foot. However, this number will vary depending on the size and geometry of the anchors. Further, for pitching mats with an anchor density below about 100 anchors per square foot, the inventor suggests adding additional weight to the pitching rubber. Typically, an additional one to five pounds is sufficient. Further, the anchor density will depend on the type of anchor. For instance, the relatively simple geometry of the anchor depicted in FIG. 5A will require a higher density, but a lower density could be used for the golf-spike anchor as shown in FIG. 5D. In one embodiment, the density of anchors in a rubber area of the pitching mat under the pitching rubber is greater than density of anchors in a foot area of the pitching mat designated for a pitcher to plant her foot.

FIG. 4B depicts a polygonal pattern for the placement of the anchors 25 in which the anchors are placed in a series of concentric circles. Besides circles, nested polygons would work as well. FIG. 4C depicts an embodiment in which the anchors 25 are most dense in the areas under the pitching rubber 40 and under the area where the pitcher would plant her foot. The areas outside those regions also feature anchors 25, but they are less densely populated.

Figure 5A:
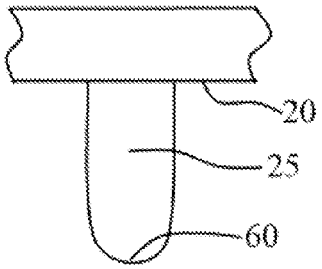
FIGS. 5A-G depict a plurality of anchor embodiments.
Figure 5B:
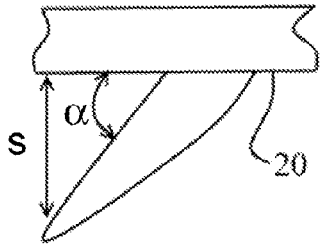
Figure 5C:
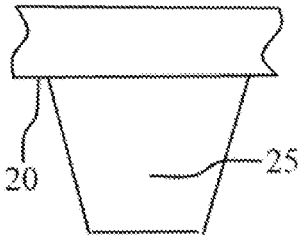
Figure 5D:
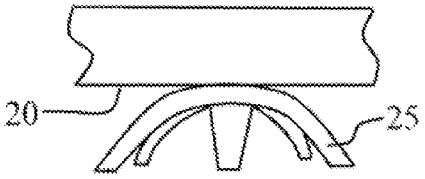

FIGS. 5A-G show a variety of alternate embodiments for the design of the anchor 25. FIG. 5A shows the primary embodiment of the anchor 25 as depicted in FIG. 1. This anchor 25 is essentially a rod with a rounded tip 60. The rounded tip 60 allows the anchor 25 to slide easily through the thicket of fibers 6, 7. The anchors 25 are preferably between 0.2 and 1 inch in length. In a most preferred embodiment, the anchor 25 as shown in FIG. 5A is 0.5 inches in length. This length is long enough to penetrate the fibers 6, 7 and the infill material 8, but not long enough to reach the floor below. Further, the anchors 25 are preferably between about 0.0625 and about 0.5 inches in thickness; although smaller or larger thicknesses can be used.

The alternate embodiments depicted in FIGS. 5B-G operate in a similar fashion to the primary embodiment as shown in FIG. 5A, that is, each anchor is designed to engage the fibers 6, 7 and infill material 8.

FIG. 5B shows an angled anchor. The angle $\alpha$ is between 15 degrees and 75 degrees. The anchor 25 points toward the second end 35, such that the anchor resists movement of the mat in the direction of the pitch. The angled anchor 25 also features a rounded tip. The length of the anchor 25 will vary depending on the angle $\alpha$, but the vertical depth S should between 0.2 and 1 inch and, preferably, at a depth of 0.5 inches. Under extreme force, the primary anchor embodiment as depicted in FIG. 5A might bend or shear under the resistive forces of the fibers and infill material. The angled anchor is designed to provide greater resistance under those extreme forces because the angle allows the anchor to dig even further into the fibers and infill material.

Figure 5E:
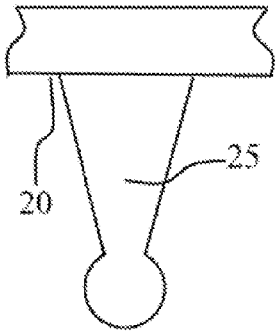
Figure 5F:
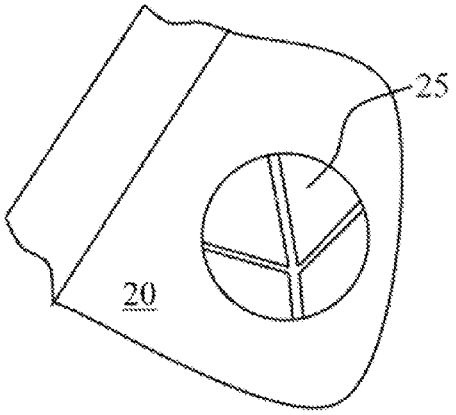

FIG. 5C depicts a frustoconical anchor 25. The furstoconical anchor provides a greater surface area to engage the fibers and infill material, while the conical shape allows the anchor to slide easily between the fibers. FIG. 5D depicts an anchor 25 that resembles a golf spike. The design of the anchor is shallower and provides more surface area to grab the artificial fibers. Thus, this embodiment works best on first generation turf fields. FIG. 5E depicts a frustoconical anchor 25 with a sphere at the tip. The frustoconical portion provides greater surface area to engage the fibers. The spherical tip allows the anchor to slip between the fibers and embed in the infill material. FIG. 5F depicts an anchor 25 similar to the tip of a Phillips head screwdriver. The tapering edges of this embodiment allow the anchor to penetrate the fibers and infill material. The flat sides create a greater surface area perpendicular to the direction of the pitcher's momentum, increasing the amount of resistance experienced by the anchor.

Figure 5G:
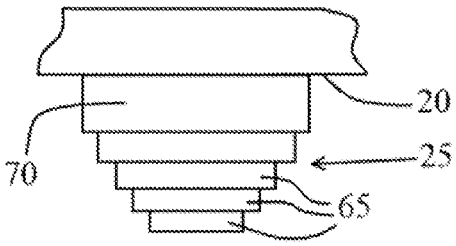

FIG. 5G depicts a collapsible anchor embodiment in which a plurality of nesting layers 65 collapse into a housing 70. The anchors 25 as depicted in FIGS. 5A-F are typically made of rigid plastic. Using a collapsible anchor will prevent the anchor from snapping if the pitching mat is used on uneven terrain or if there is a hidden obstruction, like a rock in the turf. The collapsible anchor can optionally feature an embedded ferromagnetic material. In that way, the user can wave a magnetic bar over the collapsed anchors to pull them into extended position instead of manually extending each anchor. Further, the collapsible anchor could contain an embedded spring, such that the anchor will collapse as needed and then extend once the obstruction is removed.

The various embodiments as depicted in FIGS. 5A-G are illustrative and not limiting. Additional designs for anchors 25 could be utilized with the present invention. Any of the anchors 25 shown in FIGS. 5A-G could be arranged according to the patterns shown in FIGS. 4A-C. The styles of anchors can be combined within a single pitching mat, ensuring that if a particular style of anchor is not compatible with the artificial turf, other anchors will support the mat.

In one embodiment, the anchors 25 are be made of the same material as the pitching mat, while in another embodiment, the anchors comprise a different material. The anchors 25 are integrally molded into the pitching mat, or they are subsequently attached to the pitching mat, in different embodiments. Therefore, the second side 20 of the pitching mat 10 could feature a number of indentations in to which the anchors 25 are reversibly or irreversibly snapped, fitted, threaded, or otherwise attached. Thus, the anchors 25 could be individually removable.

Removable anchors 25 would allow for replacement of damaged anchors 25, and the anchors 25 could be removed from the pitching mat 10 so as to allow it to be used on a tile or wood gym floor. Though, this embodiment as described allows for removable anchors, a separate embodiment is provided below which facilitates quick removal of a large number of anchors at a time, hastening the transition from a mat for use with artificial turf to a mat for use on a gym floor.

Removable Anchor Embodiment

In an alternative embodiment, shown in FIGS. 6A to 7, the pitching mat 100 features removable anchors 125. The permanent, or occasionally removable, anchors 25 of the previous embodiment do not allow the pitching mat to be conveniently used on surfaces other than artificial turf or grass. In this embodiment, the anchors 125 are quickly removable, which allows the pitching mat 100 to be used on all surfaces. As shown in FIGS. 6A-B, the pitching mat 100 is essentially the same as the previous embodiment in that it contains a first side 115, a second side 120, a first end 130, a second end 135, and a pitching rubber 140 mounted on the first side 115 proximal to the first end 130. In this embodiment, however, the anchors 125 are removable from the second side 120.

The anchors 125 are attached to a plurality of substrates 155. Each substrate 155 has a first face 160 and a second face 165. The first face 160 of each substrate 155 is designed to engage a matching recessed region 170 on the second side 120 of the pitching mat 100. The anchors 125 are attached or integrally molded to the second face 165. When the substrates 155 engage the recessed regions 170, the second face 165 should be substantially flush with the second side 120 of the pitching mat 100.

As depicted in FIG. 6A, the recessed regions 170 are channels, in one embodiment. As depicted in FIG. 6B, the recessed regions 160 are rectangular in another embodiment; although, other polygonal shapes may be used. The substrate 155 can engage the recessed regions 170 in a variety of ways. In the channel embodiment of FIG. 6A, the substrate 155 can slide into the recessed region 170 from one end of the pitching mat 100. As can be seen in FIG. 7, a small protruding lip 175 on the edge of the recessed region 170 secures the substrate 155 in place. Alternatively, the substrate 155 can engage the recessed region 170 through a hook and loop fastener or a threaded fastener.

When a pitcher desires to use the pitching mat 100 on an artificial turf surface 9, the pitcher attaches the substrates 155 to the recessed regions 170. When the pitcher desires the use the pitching mat 100 on tile or wood floors, such as in a gymnasium, the substrates 155 are removed. With the substrates 155 removed, the second side 120 of the pitching mat 100 can frictionally engage the gymnasium floor. Because the recessed regions 170 will produce small indentations, it is recommended that the recessed regions 170 not be placed in the area around where the pitcher will plant her foot. Thus, as can be seen in FIG. 6A, the recessed regions 170 are placed along the longitudinal edges of the pitching mat 100. In one embodiment, the channels are placed along the longest edges of the pitching mat 100, with the channels placed within 10 inches of the longest edge, in one embodiment.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The invention claimed is:

1. A portable pitching mat, said mat comprising: a single layer mat capable of being rolled or folded, wherein the mat has a first side with a first end and a second end, wherein the first side is substantially flat and has a weight attached proximal to the first end and wherein a pitcher can perform an entire pitching motion on the first side of the mat, and a second side, wherein the second side engages an artificial turf substrate with a plurality of anchors; a pitching rubber on the first side proximal to the first end and wherein density of anchors in a rubber area of the pitching mat under the pitching rubber is greater than density of anchors in a foot area of the pitching mat designated for a pitcher to plant the pitcher's foot.

2. A portable mat, said mat comprising: a first side with a first end and a second end, wherein the first side is substantially flat; a second side, wherein the second side has a plurality of recessed regions; and a plurality of substrates, wherein each of the plurality of substrates comprises: a first face that reversibly engages one of the plurality of recessed regions on the second side; a second face that engages an artificial turf surface with a plurality of anchors and wherein the first face of the plurality of substrates engages the recessed region via a hook and loop fastener.

* * * * *